United States Patent [19]

Engel

[11] 4,415,158

[45] Nov. 15, 1983

[54] PUZZLE

[75] Inventor: Douglas A. Engel, Englewood, Colo.

[73] Assignee: General Symmetrics, Inc., Englewood, Colo.

[21] Appl. No.: 304,092

[22] Filed: Sep. 21, 1981

[51] Int. Cl.[3] ..... A63F 9/08

[52] U.S. Cl. ..... 273/153 S; 273/155; 434/124

[58] Field of Search ..... 273/153 S, 155; 434/124

[56] References Cited

U.S. PATENT DOCUMENTS

| | | | |
|---|---|---|---|
| D. 190,660 | 6/1961 | Mote | 273/157 R |
| 636,109 | 10/1899 | Bowers | 273/155 |
| 3,628,795 | 12/1971 | Hopkins | 273/161 |
| 3,655,194 | 4/1972 | Pierson | 273/288 X |
| 3,690,672 | 9/1972 | Dreyer | 273/155 |
| 4,270,754 | 6/1981 | Imatt | 273/284 X |

FOREIGN PATENT DOCUMENTS

| | | | |
|---|---|---|---|
| 8104382 | 7/1981 | Fed. Rep. of Germany | 273/153 S |
| 2405077 | 5/1979 | France | 273/153 S |
| 2463632 | 2/1981 | France | 273/153 S |
| 170062 | 12/1977 | Hungary | 273/153 S |
| 55-3956 | 1/1980 | Japan | 273/153 S |
| 55-8192 | 3/1980 | Japan | 273/153 S |
| 55-8193 | 3/1980 | Japan | 273/153 S |
| 434284 | 8/1935 | United Kingdom | 434/124 |

*Primary Examiner*—Anton O. Oechsle
*Attorney, Agent, or Firm*—Crandell & Polumbus

[57] ABSTRACT

Puzzles, including both two dimensional and three dimensional versions, are comprised of movable segmented segments on a base. In various embodiments the base is a sphere. The segmented sections form geometric figures and each geometric figure has a common segmented section with another geometric figure. In the two-dimensional version the geometric figure is in the form of a circle. In the three-dimensional versions the geometric figure is in the form of a sphere; a square, with the segmented sections forming a cube; a triangle, with the segmented sections forming tetrahedron; or a pentagon, with the segmented sections forming a dodecahedron.

12 Claims, 30 Drawing Figures

PUZZLE

BACKGROUND OF THE INVENTION

This invention relates to the area of puzzles, and more particularly to a puzzle having movable segmented sections.

Prior art puzzles include the "15 puzzle", which required the restoration of scrambled pieces to their proper order in a two-dimensional plane. The puzzle comprises fourteen movable pieces set on a base with movement allowed between fifteen possible spaces.

One of the most well known of prior art puzzles is the popular "Rubik's Cube", "Crazy Cube", or "Magic Cube". This puzzle consists of a cube, each face being comprised of a 3×3 matrix of small cube sections mounted so that each face could rotate about its center without the cube falling apart. Each face would initially be a single color, and therefore scrambled by rotations of the cube faces. The interior structure of the cube comprises a spindle having six axles. The central cube section of each face is attached to each axle and the cube sections retain one another without being attached to each other. The cube sections pivot around orthogonal axes.

Other prior art puzzles include devices such as those of U.S. Pat. No. 563,986 to Jones, and U.S. Pat. No. 636,109 to Bowers. The former patent discloses a puzzle having pieces or checkers movable in a figure 8 configuration. The patent to Bowers comprises a base forming four disks, each pivotable about its center. Each of the disks includes four segments, two of which intersect adjacent disks.

SUMMARY OF THE INVENTION

The present invention provides a puzzle of novel and amusing character, that may also be used in the teaching of group theory as it pertains to the higher mathematics and in the field of coding and decoding. Structurally the puzzle provides circularly movable segmented sections. The segmented sections alternatively intersect more than one geometric figure. The intersecting or common section of two figures is segmented into more than one piece. A further embodiment comprises movement of these segmented sections about a central sphere. Movement is achieved by means of convex and concave rabbeted portions.

BRIEF DESCRIPTION OF THE DRAWINGS

The above and other features and objects of the invention will be better understood from the following detailed description of the typical embodiments illustrated in the accompanying drawings in which.

DESCRIPTION OF THE PREFERRED EMBODIMENTS

Figure 1:
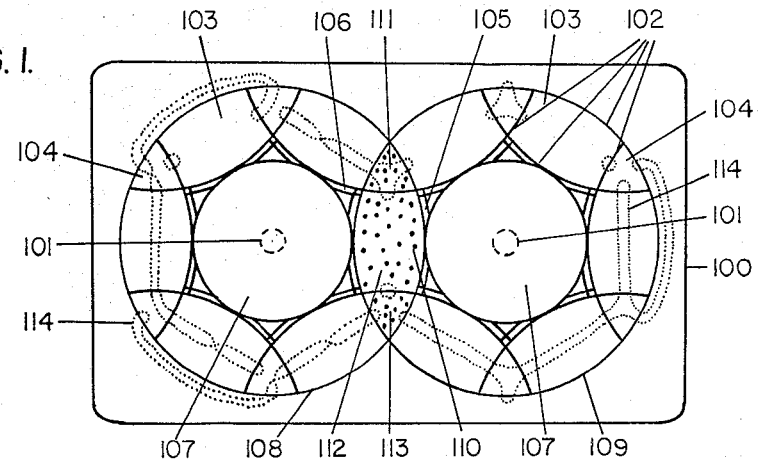
FIG. 1 is a plan view of a two-dimensional version of the puzzle of the invention.

FIG. 1 illustrates a two-dimensional embodiment of the invention. The term "two-dimensional" is used here not to describe the puzzle structure as having, in a strict geometrical sense, only two dimensions, but rather to distinguish this and other embodiments. Thus movement of the various pieces is confined to a plane, whereas in further embodiments such movement can take place in three-dimensional space. In the three dimensional embodiments as seen in FIGS. 22 through 30, the pieces will appear as in FIG. 1 relative to parallel planes through the invention.

Element 100 is a base used to retain the pieces or segments of the puzzle. The dissimilar basic pieces 103 and 104 of the puzzle rotate about central axes 101 (perpendicular to the plane of the paper) coincident with circular center sections or pins 107. In the embodiment of FIG. 1 the circular center sections 107 are fixed to the base 100. The pieces 103 and 104 are arranged as shown to form geometric figures, particularly intersecting whole circles 108 and 109. A rotatable segmented section is composed of basic piece 103 and two basic pieces 104. The shape of the thus composed segmented section is defined by the arcs of dissection 102, each arc having a radius equal to the radius of the circles 108 and 109. As seen in FIG. 1, there are six overlapping segmented sections. Element 110 is the intersecting segmented section (i.e., that section composed of basic pieces which are common to both geometric figure 108 and geometric figure 109) and which defines a common intersection or zone. Intersecting segmented section 110, (dotted here and in FIG. 2 only to show its movement), is composed of basic pieces 111, 112, and 113.

Figure 2:
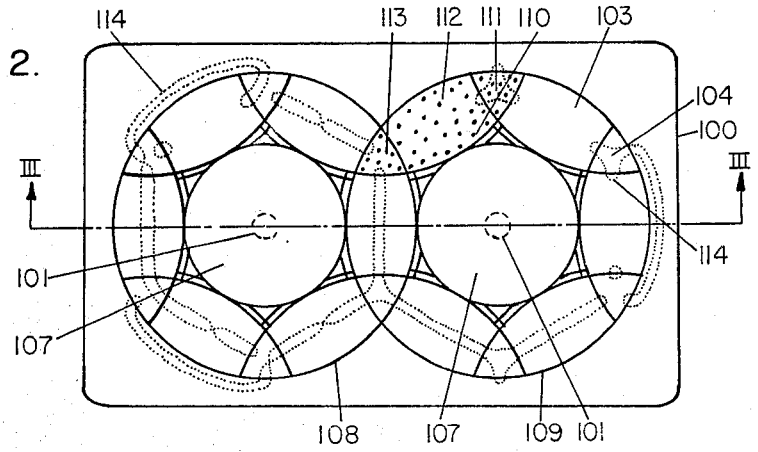
FIG. 2 shows the puzzle of FIG. 1 after movement of a segmented section.

FIG. 2 illustrates segmented section 110 after a 60° rotation of the pieces in circle 109. After 60° of rotation, the next overlapping segmented section to section 110 is brought into the common intersection between the geometric figures. Basic pieces 111 and 112 are now solely contained in circle 109. Only piece 113 of the segmented section 110 is in the common intersection between both circles 108 and 109. Any rotation of the puzzle pieces about the axis of circle 108 will carry piece 113 away from circle 109 and thus begin to jumble or scramble section 110. Further movement of the pieces about alternate axes 101 would operate to scramble any or all of the segmented sections in a similar manner. All of the basic pieces can be moved from a first position within either circle 108 or 109 to a second position in the other circle outside the common intersection. The second position is symmetrical with respect to the first position, that is, the position the piece has in the second circle corresponds to the orientation and position the piece had in the first circle.

An important application of the invention is shown by the dotted line diagram 114. This illustrates a topological diagram which may be placed (by etching or other means), on the surface of the basic pieces or sections and the base. The puzzle can be manipulated to form a large number of different ring patterns making it a practical educational aid in fields such as topology, crystallography, chemistry, symmetry studies, design studies, art and genetics. The diagram on the surfaces may also be in the form of arms, legs, snakes, roadways, or electrical circuits for additional applications of the puzzle.

Figure 3:
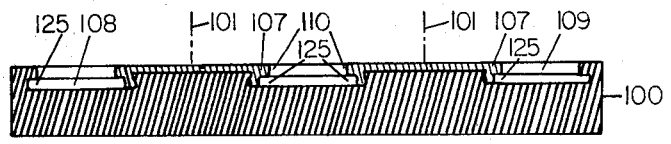
FIG. 3 is a sectional along line III—III of FIG. 1 with sections removed.

FIG. 3 is a section taken on the line III—III of FIG. 2. It illustrates a method of retaining the basic pieces forming the segmented sections or the base 100. The rabbeted groove or portion 125 of the base cooperates with convex rabbeted portions 105 and concave rabbeted portions 106 of the basic pieces. Each central piece 107 is molded or otherwise fixedly secured to a circular projection of the base 100.

Figure 4:
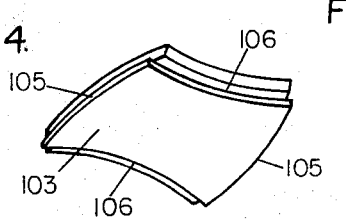
FIGS. 4 and 5 each show a movable segment of FIG. 1.
Figure 5:
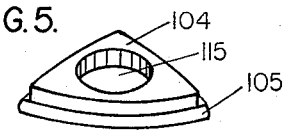

FIGS. 4 and 5 show the two types of basic pieces 103 and 104 and their convex and concave rabbeted portions. In FIG. 5 element 115 designates a finger access. cutout similar to that of a dial telephone, and such as may be included in either basic pieces 103 or 104. Convex rabbeted portions 105 of both the basic pieces 103 and 104 engage portions 125 of the base 100. The concave rabbeted portions on each of the 103 pieces engage the adjacent convex rabbeted portion of the adjacent 104 piece.

To operate the puzzle of FIGS. 1–5 the geometric figures 108 and 109 are rotated one at a time in increments of 60°. Thus the intersecting or common segmented section is always rotated, but the other segmented sections are rotated only along with their particular geometric figure. Thus the pieces can easily be scrambled. To return the pieces to a start position, designated by pictures, colors or diagrams forms a difficult and novel puzzle.

Figure 6:
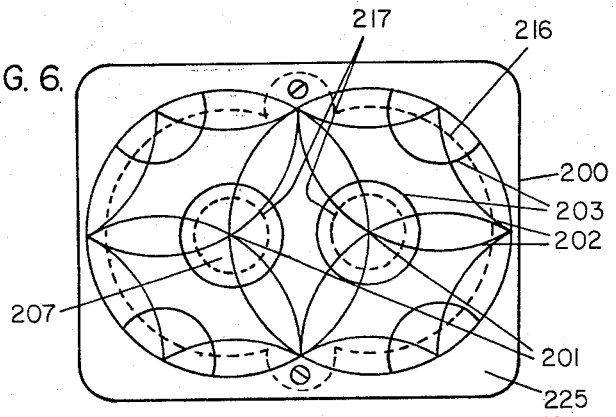
FIG. 6 is a plan view of a further two-dimensional embodiment.

FIG. 6 is a plan view of another embodiment of the invention showing two large rotatable circles and two smaller rotatable circles or circular pieces each concentric to the larger rotatable circles about the central pivot axis 201. Rotation of the circles in increments of 120° provides a new intersecting segmented section. Element 202 shows the arcs of dissection as provided by the larger circles and 203 the arcs of dissection of the smaller circles. A transparent cover 216 is provided to retain the pieces of each geometric circle on the base 200. Cutouts 217 in the transparent cover provide finger access for rotation of the two smaller interior circles. The base 200 has a raised portion 225 which retains all the pieces which come into contact with the outer periphery of the outline of the larger circles. In this embodiment greater complexity is provided. The intersecting segmented section is composed of eleven basic pieces.

Figure 7:
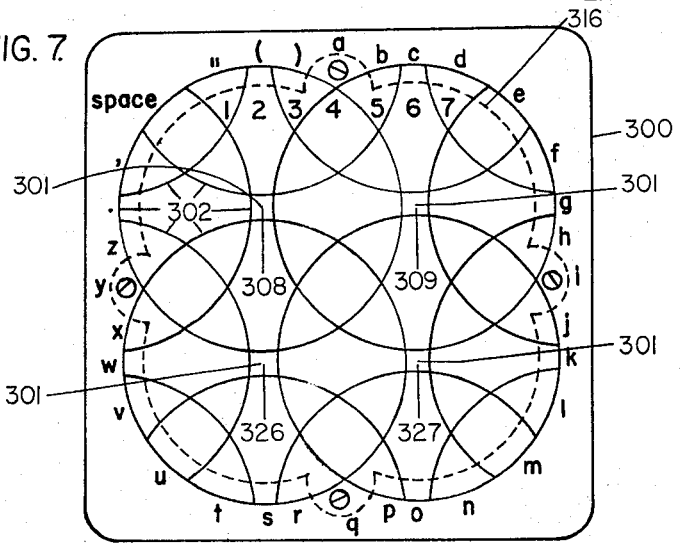
FIG. 7 is a plan view of a further two-dimensional embodiment used as a coding device.

FIG. 7 is a plan view of an embodiment of the invention suitable for use in coding and decoding. Four circles 308, 309, 326, 327 composed of segmented sections are rotatably mounted on base 300 about central pivot axes 301. Indicia in the form of the alphabet and various punctuation elements, plus space designations are provided on the base. Other indicia could be substituted if desired. The pieces designated as 1, 2, 3, 4, 5, 6 and 7 are considered the coding pieces and their movement will indicate the appropriate character of the message. For example, to encode the letter "p" as the first letter of a message, rotate circle 308 by 90°, circle 309 by 180°, and circle 327 by 180°. Thus coding piece 1 is at the position across from indicia "p". The rotation 1($308^1$, $309^2$, $327^2$) would be used to indicate the indicia "p" of the message. The superscripts indicate the number of 90° rotation increments required of each geometric circle to place the stated coding piece ("1") opposite the encoded character ("p"). Any desired coding piece may be used which can be brought to positionally correspond to the letter to be coded by a sequential set of 90° rotational increments. Since further coding mixes up the coding pieces, and for decoding, the pieces need to be in their original starting position as in FIG. 7, the message will be difficult of decipher.

Figure 8:
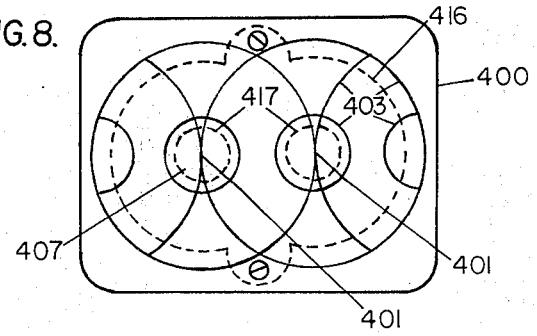
FIG. 8 is a plan view of a further two-dimensional embodiment.

FIG. 8 shows a base 400 having concentric circles pivotable about central pivot points 401. The basic pieces are retained on base 416 by means of transparent cover 416. The basic pieces are such that rotation of the circles in increments of 180° provides a new intersecting segmented section.

Note that in each of the puzzles of FIGS. 1–8 the intersecting section is segmented.

Figure 9:
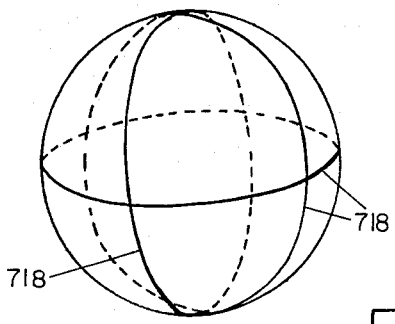
FIG. 9 is a perspective view of a sphere showing three perpendicular planes of dissection.

FIG. 9 is a perspective view of a sphere sliced by the mutually perpendicular planes of dissection 718.

Figure 10:
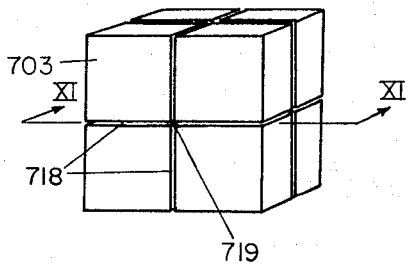
FIG. 10 is a perspective view of a cube puzzle.

FIG. 10 shows a cube type puzzle having four sides each formed of a 2×2 matrix of cube pieces. The present improvement over the well known cube puzzle includes the use of a central sphere or ball 720 against which the cube pieces are retained. FIG. 10 is a perspective view of the cube puzzle showing the basic piece 703 and two of the slice planes 718. The intersecting segmented section of the puzzle is formed by each cube piece being common to more than one surface.

Figure 11:
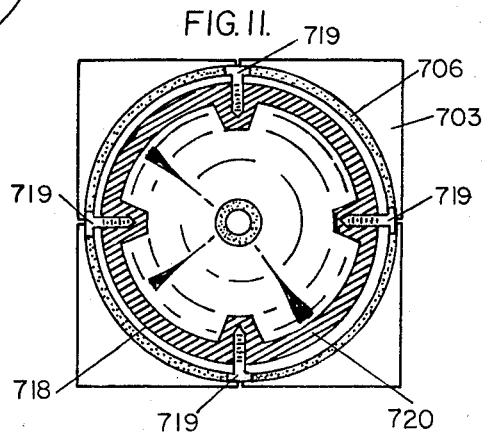
FIG. 11 is a sectional view taken along the line XI—XI of FIG. 10 showing the central sphere or ball.

FIG. 11 is a section along the line XI—XI of the cube puzzle of FIG. 10. Central sphere 720 is shown as generally hollow, with retaining pins 719. These pins 719 extend out from the surface of the sphere at each intersection of the mutually perpendicular dissecting planes 718. Thus there are a total of six of these headed pins. The basic pieces 703 have concave rabbeted portions 706, (shown as stipled grooves in FIGS. 11–13), to engage the disc shaped protruding heads of retaining pins 719.

Figure 12:
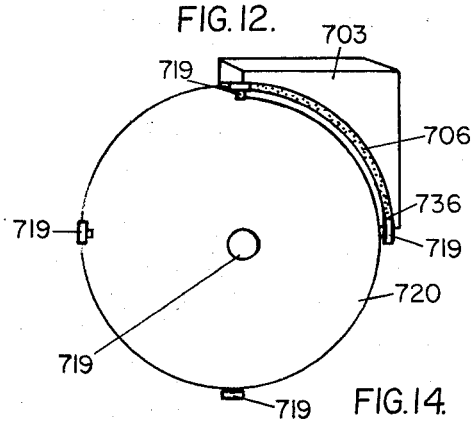
FIG. 12 is a perspective view of the central sphere of FIG. 11.
Figure 13:
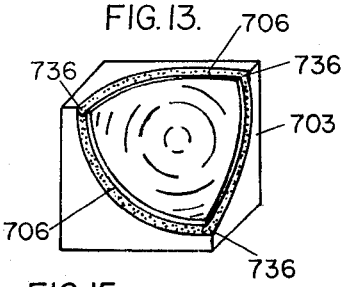
FIG. 13 is a perspective view of a basic movable piece of FIG. 10.

FIG. 12 similarly shows the central sphere 720, retaining pins 719 and one of the basic pieces 703. A single one of the basic pieces 703 must be glued or otherwise permanently attached to the central sphere, with the three intersections 736 (see FIG. 13) of the rabbeted portions 706 engaging three of the retaining pins 719, to be used as a reference piece. The permanent attachment of this one basic piece to the central sphere 703 does not affect the ability of any of the pieces or the attached piece to move relative to one another since the sphere and attached piece rotate as a single unit. The heads of the retaining pins would move with the sphere and fixed piece in the grooves formed by the pairs of facing rabbeted portions 706 of the remaining pieces.

Figure 14:
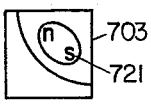
FIGS. 14 and 15 show alternative embodiments of a basic movable piece of FIG. 10.

FIG. 14 shows a basic piece 703 having an embedded magnet 721. Thus by using a central ball of a thin ferrous material the pieces 703 can be retained by magnets in lieu of the above-described rabbeted portions and retaining pins.

Figure 15:
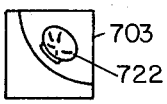

Similarly, FIG. 15 shows a basic piece 703 having an attached atmospheric suction cup, 722. Thus the central ball or sphere could be smeared with a thin oil and the basic pieces 703 would be retained by the atmospheric suction cup 722 and atmospheric pressure.

Figure 16:
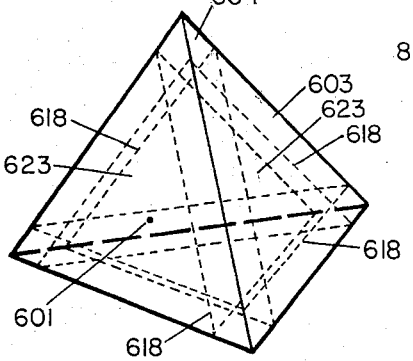
FIG. 16 is a perspective view of a regular tetrahedron shown from cutting planes.

FIG. 16 shows a regular tetrahedron sliced equally by four planes of dissection at equal depth, under and parallel to each face plane. This produces 14 exterior pieces of three basic types, 603, 604 and 623 and normally one small interior regular tetrahedron at the center of the original regular tetrahedron.

Figure 18:
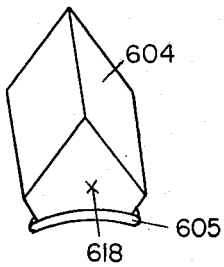
FIGS. 18, 19 and 20 are perspective views of basic movable pieces of the tetrahedron puzzle.
Figure 17:
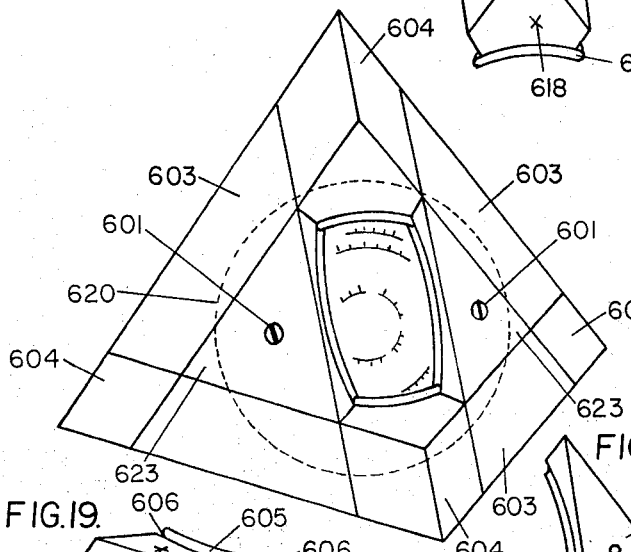
FIG. 17 is a perspective view of a tetrahedron puzzle.
Figure 19:
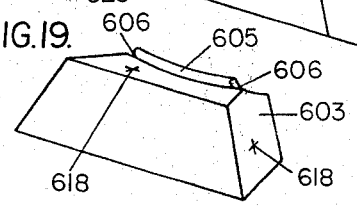

FIG. 19 shows the tetrahedron puzzle with one of the basic pieces 603 removed. The basic pieces of the puzzle 601 of FIG. 17 are identical to the 14 exterior pieces of the dissected tetrahedron of FIG. 16, except that the inwardly facing surfaces thereof, rather than defining a smaller interior tetrahedron, are shaped as concave spherical surfaces which slidably engage interior sphere 620 which is shown by dotted outline. Basic pieces 623 are permanently but rotatably pinned to the central sphere at pivot pins 601. The remaining basic pieces are slidably secured to each other by means of rabbeted portions, and thus rotational movement is allowed about pivot points 601. FIG. 18 shows rabbeted portions 605 on basic piece 604. A surface defined by a slice plane 618 is also shown.

FIG. 19 shows basic piece 603, convex retaining rabbeted portions 605, and concave retaining rabbeted portions 606.

Figure 20:
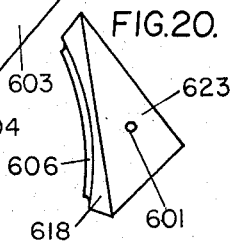
Figure 23:
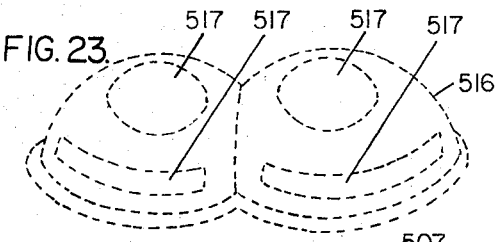
FIG. 23 is a perspective view of the transparent cover of FIG. 22.
Figure 22:
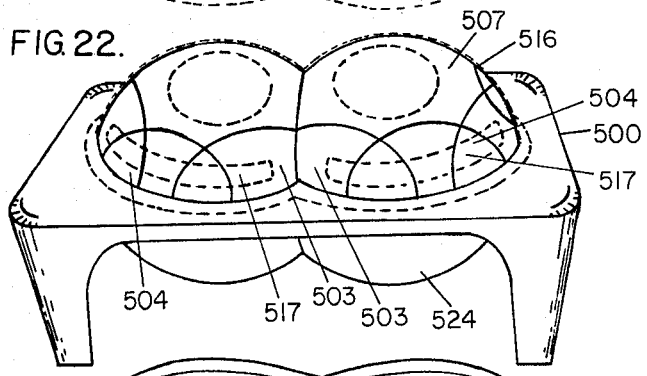
FIG. 22 is a perspective view of a two-sphere puzzle.

FIG. 20 shows basic pieces 623 normally fixedly mounted for rotation about pivot points 601. Slice plane 618 is shown along with concave rabbeted portions 606.

The operation of the tetrahedron puzzle is as follows. The basic pieces 623, 604 and 603 are rotatably mounted about pivot points 601. Basic pieces 603 and 604 are retained on the surface of central ball 620 by a means of cooperating of mutually engaging convex and concave rabbeted portions. These rabbeted portions couple the basic pieces 603 and 604 to fixedly mounted pieces 623. Thus all the basic pieces can be alternatively rotated about pivots 601. The intersecting segmented sections common to two surfaces of the tetrahedron are defined by pieces 603 and 604. Various diagrams, colors and patterns could be provided on the basic pieces for scrambling and unscrambling thereof. Thus, like the two-dimensional puzzle of FIGS. 1–8 the basic pieces 603 and 604 combine to form a segmented section. In this case the segmented sections comprise one piece 603 flanked by two 604 pieces. Each such segmented section is common to two geometrical figures (in this case triangles) and these sections form these triangular figures about three non-orthogonal rotational axes 601 and are movable on a spherical base.

Figure 21:
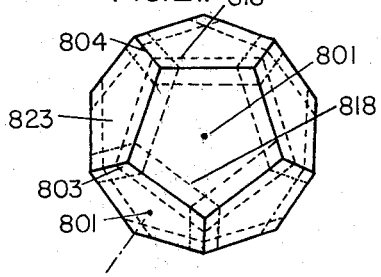
FIG. 21 is a perspective view of a regular dodecahedron puzzle showing the cutting planes.

FIG. 21 shows a regular dodrahedron puzzle according to this invention. Each planar face is parallel to a cutting plane which cuts the geometric solid at a uniform depth below each face. These planes thus divide the outer portion of the solid into 62 movable pieces. Pentagonal pieces 823 are each pinned to the central sphere or ball (not shown) for rotation about non-orthogonal axes in a manner similar to basic pieces 623 of the tetrahedron puzzle of FIGS. 16–20. Corner basic pieces 804 and edge basic pieces 803 are movably retained on the surface of the spherical ball base by means of convex and concave rabbeted portions (not shown) in the manner as set forth with reference to FIGS. 16–20.

Figure 24:
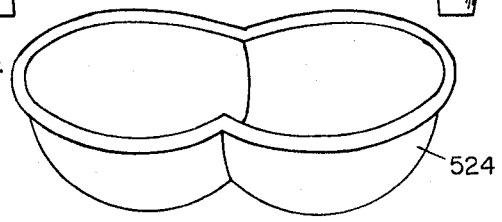
FIG. 24 is a perspective view of the undercover of FIG. 22.
Figure 25:
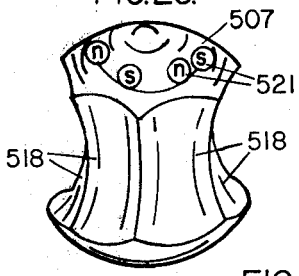
FIG. 25 is a perspective view of the central piece of FIG. 22.
Figure 26:
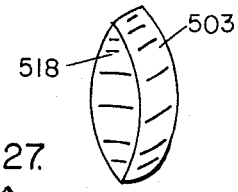
FIGS. 26 and 27 are perspective views of basic movable pieces of FIG. 22.

A twin sphere embodiment of the present invention is shown in FIGS. 22 through 30. This puzzle comprises a pair of central pieces 507 about which rotation of basic pieces 504 and 503 occur. The pieces are retained on base 500 by means of a transparent overcover 516 (FIG. 23) and an undercover 524 (FIG. 24). Cutouts 517 for finger access are provided in the transparent cover to provide selective movement of basic pieces 503, 504, and 507. The basic pieces 503 and 504 can be pivotally retained with reference to central piece 507 by means of permanent magnets 521 (FIG. 25). In this case, basic pieces 503 and 504, as well as central piece 507, include surfaces defined by spherical surfaces of dissection whose radius equals that of the twin intersecting spheres. Any plane through the twin spheres and perpendicular to the axis of rotation of central piece 507 will present a circular cross section with a plan view as seen in FIG. 1.

FIG. 25 shows the thus defined surfaces 518 on piece 507. All surfaces of pieces 503 and 504 are either defined by these surfaces of dissection or the outer surface of the spheres.

FIGS. 26, 27, 28 and 29 show the basic pieces 503 and 504 and thus these surfaces.

Figure 30:
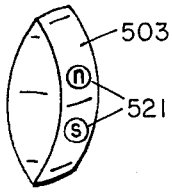
FIG. 30 is a perspective view of a basic piece of FIG. 22 with embedded magnets.
Figure 27:
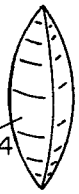
Figure 28:
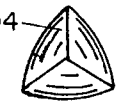
FIGS. 28 and 29 are plan views looking down or basic pieces of FIG. 22.
Figure 29:
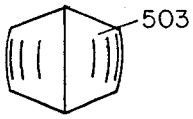

FIG. 30 shows a basic piece 503 having embedded magnets 521 to cooperate with the magnets of central piece 507. Suction cups may be substituted for the magnets in order to retain the basic pieces 503 and 504. The basic pieces 503 and 504 of FIG. 23 may be rotated about the axis of either sphere to vary the puzzle. The exterior portions of the pieces may be covered with diagrams, pictures or letters to identify the puzzle pieces. Thus the pieces must be returned to their proper places to affect a solution to the puzzle.

While certain specific embodiments of the present invention have been disclosed as typical, the invention is of course not limited to these particular forms, but rather is broadly applicable to all such variations as fall within the scope of the appended claims.

What is claimed is:

1. A puzzle comprising a base for rotatably supporting segmented sections cooperating to form at least two geometric figures of circular cross section, said segmented sections being rotatable about non-orthogonal axes, the geometric figures overlapping to form an area of common intersection in a plane through the geometric figures, said segmented sections being defined along an outer edge by the locus of said circular cross sections and along an inner edge by an arc of radius equal to the radius of said circular cross section in said plane, each of said segmented sections dissected by at least two other arcs of radius equal to the radius of said circular cross section in said plane to form at least three separate pieces, each of said pieces being movable to a position anywhere in any of said geometric figures including the area of common intersection.

2. The invention defined in claim 1 wherein each of said pieces has means along an edge thereof for making sliding contact with any piece adjacent thereto.

3. The invention defined in claim 2 wherein said puzzle further includes a cover permanently mounted to said base and covering a portion of said pieces, leaving uncovered the remaining portion of said pieces.

4. The invention defined in claim 2 wherein said rotational axes are coincident with pins fixedly mounted to said base and a cover is fixedly mounted to said pins.

5. The invention defined in claim 1 wherein said geometric figures are whole circles, each of said circles formed from six overlapping segmented sections and a circular center section, each of said segmented sections formed of three pieces.

6. The invention defined in claim 1 wherein said geometric figures are spheres, each of said spheres formed of a central section rotatable about a respective one of said axes and twelve basic pieces defining six overlapping segmented sections in said plane, said basic pieces conformable to said central section and maintained in contact with said central section by said base.

7. A puzzle having a planar base for rotatably supporting a plurality of pieces each cooperating with a center circular section to form at least two whole circles of equal radius and having an area of common intersection formed of more than one of said pieces, each individual piece is defined by at least three arcs, each arc having a radius equal to that of said whole circles, each of said pieces being movable with respect to other of said pieces along said arcs upon rotation of said whole circles from any one of said whole circles to a position in any other of said whole circles.

8. The invention as defined in claim 7 wherein said puzzle pieces and said center circular sections define a plane through at least two three-dimensional geometric figures having circular cross sections in said plane.

9. The invention as defined in claim 7 wherein said puzzle further includes:

at least one smaller concentric circular piece completely within each of said whole circles, some of said pieces further defined by at least one arc of radius equal to that of said smaller concentric circular piece and at least one arc of radius equal to that of said whole circles.

10. The invention as defined in claim 7 wherein said pieces are symmetrically positionable between any two overlapping whole circles.

11. A puzzle comprising a base for rotatably supporting first segmented sections cooperating to form at least two geometric figures of circular cross section, said segmented sections being rotatable about non-orthogonal axes, the geometric figures overlapping to form an area of common intersection in a plane through the geometric figures, said segmented sections being defined along an outer edge by the locus of said circular cross sections and along an inner edge by first arcs of radius equal to the radius of of said circular cross section in said plane, the first of said segmented sections dissected by at least two second arcs of radius equal to the radius of said circular cross section in said plane to form at least two separate pieces, said circular cross sections further encircling at least one concentric piece dissected into second segmented sections by at least two third arcs of radius equal to the radius of said circular cross sections, some of said second segmented sections further dissected by at least one fourth arc of radius equal to the radius of said concentric circular piece.

12. The invention defined in claim 11 wherein said concentric circular pieces are each rotatable about a respective one of said non-orthogonal axes.

* * * * *